US010475299B2

(12) United States Patent
Dolezalek et al.

(10) Patent No.: US 10,475,299 B2
(45) Date of Patent: Nov. 12, 2019

(54) MODULAR INDICATOR

(71) Applicant: Banner Engineering Corporation, Minneapolis, MN (US)

(72) Inventors: Charles Dolezalek, Stacy, MN (US); Darrell Raymond Pikkaraine, Elk River, MN (US); Maximilian John Aponte, Shakopee, MN (US); Neal A. Schumacher, Plymouth, MN (US)

(73) Assignee: BANNER ENGINEERING CORPORATION, Minneapolis, MN (US)

( * ) Notice: Subject to any disclaimer, the term of this patent is extended or adjusted under 35 U.S.C. 154(b) by 0 days.

(21) Appl. No.: 16/006,158

(22) Filed: Jun. 12, 2018

(65) Prior Publication Data

US 2018/0300995 A1 Oct. 18, 2018

Related U.S. Application Data

(63) Continuation-in-part of application No. 14/803,619, filed on Jul. 20, 2015, now Pat. No. 9,997,031.

(51) Int. Cl.
*G08B 5/38* (2006.01)
*G08B 7/06* (2006.01)
(Continued)

(52) U.S. Cl.
CPC ..... *G08B 5/38* (2013.01); *G08B 7/06* (2013.01); *G08B 21/18* (2013.01); *F21Y 2115/10* (2016.08); *H05B 33/0845* (2013.01)

(58) Field of Classification Search
CPC . F21S 2/00; F21V 23/06; F21V 15/01; F21W 2111/00
See application file for complete search history.

(56) References Cited

U.S. PATENT DOCUMENTS 5,769,532 A * 6/1998 Sasaki ..... F21S 2/005 362/237
2002/0172040 A1* 11/2002 Jautz ..... F21V 23/06 362/238
2004/0214476 A1* 10/2004 Haas ..... H01R 13/514 439/701

FOREIGN PATENT DOCUMENTS

DE 20 2007 005495 8/2007
EP 2 182 776 A1 5/2010
(Continued)

OTHER PUBLICATIONS

International Search Report and Written Opinion for Application No. PCT/US2019/036761 dated Sep. 18, 2019.

*Primary Examiner* — Hongmin Fan
(74) *Attorney, Agent, or Firm* — Merchant & Gould P.C.

(57) ABSTRACT

An indicator module in one example has a mounting portion to removably attach the module to another module or base. The indicator module also has a first set of electrodes disposed to be in contact with respective electrodes in the attached module or base. The indicator module further includes an indicator circuit, and a switch module configurable to selectively connect the indicator circuit to one of the electrodes in the indicator module. The indicator module can further include a second set of electrodes connected respectively to the first set of electrodes by conductors. The two sets of electrodes are located at respective ends of the module attach to another module at each end. In visual indicator modules, the conductors can be disposed in a more interior region of the module as compared to the visual indicator elements such as LEDs, which can be distributed near the periphery of the module.

19 Claims, 12 Drawing Sheets

(51) Int. Cl.

| | |
|---|---|
| ***G08B 21/18*** | (2006.01) |
| *F21Y 115/10* | (2016.01) |
| *H05B 33/08* | (2006.01) |

(56) References Cited

FOREIGN PATENT DOCUMENTS

| | | |
|---|---|---|
| EP | 2 996 442 A1 | 3/2016 |
| EP | 3 121 798 A1 | 1/2017 |

* cited by examiner

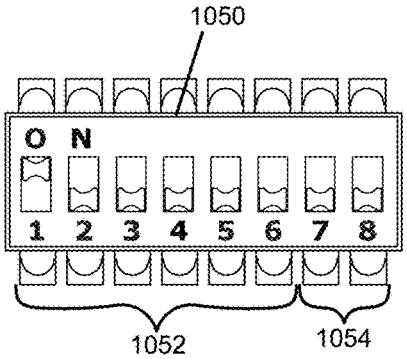
FIG. 10(a)
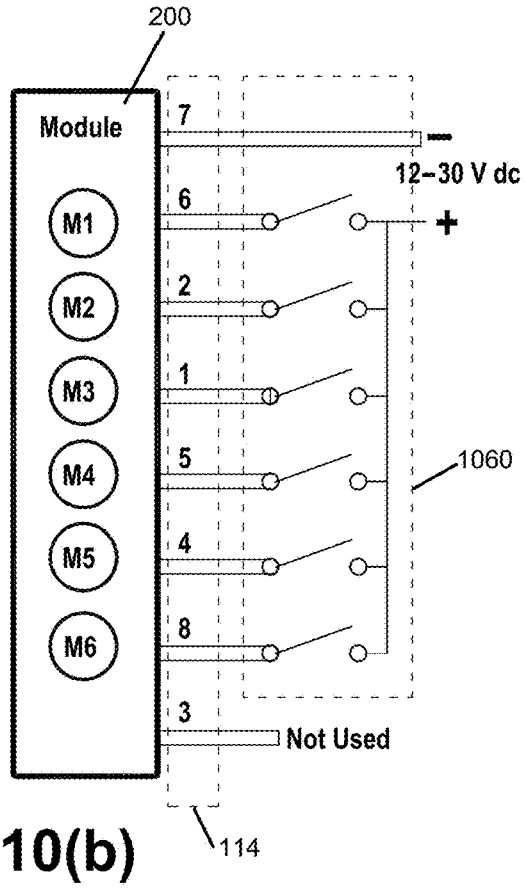
FIG. 10(b)
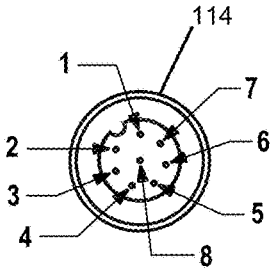
FIG. 10(c)
1 = white
2 = brown
3 = green
4 = yellow
5 = gray
6 = pink
7 = blue
8 = red
M1 = Module 1
M2 = Module 2
M3 = Module 3
M4 = Module 4
M5 = Module 5
M6 = Module 6
FIG. 10(d)

MODULAR INDICATOR

RELATED APPLICATION

This application is a continuation-in-part application of the U.S. patent application Ser. No. 14/803,619, filed on Jul. 20, 2015. The disclosure of U.S. patent application Ser. No. 14/803,619 is hereby incorporated herein by reference.

BACKGROUND

The present disclosure relates to indicator assemblies having multiple modular indicator elements. Examples of such assemblies include assemblies sometimes known as "tower lights," "stack lights" or "tower stack lights." Such assemblies find wide range of applications, from safety, automation and workflow management in industrial settings to status indication in office settings. In a typical assembly of this kind, multiple indicator modules, such as LED light modules, which are typically cylindrical in shape, are connected together in series along a longitudinal axis. The module at one end of a series is connectable to a base having multiple electrodes, each connected to a wire or connector pin for conducting electrical signal (i.e., power) from a signal source, such as a controller, to the respective electrode. Each module may have multiple conductors running from one end of the module to the other, typically near or inside the cylindrical housing wall of the module. When the modules are connected together, the conductors form multiple conductive paths through the assembly such that each of the conductors in each module is connected to a corresponding electrode in the base to receive an electrical signal. Each module also has one or more indicator circuits, such as LED elements, often with associated electronic components for various purposes, such as intermittent signaling and surge protection. The indicator is typically connected to one of the conductors. The angular position (rotational about the longitudinal axis) between each pair of adjacent modules is typically fixed, for example by bayonet-type mounts. Thus, the order of the modules in the series typically determines which electrode in the base corresponds to the indicator circuit in each module. Such an arrangement imposes certain constraints and complications on the design and deployment of such indicator assemblies and associated components such as controllers and cables.

SUMMARY

In one aspect of this disclosure, an indicator module includes a body portion having a mounting portion, such as a bayonet mount, to removably attach the module to another module, such as a module of the same kind. The module also includes a first plurality of electrodes attached to the body portion and disposed to be in contact with respective ones of a plurality of electrodes in the attached module or base. The indicator module further includes an indicator circuit, such as a visual or audio indicator circuit, and a switch module, such as a DIP switch, operatively connected to the first plurality of electrodes and to the indicator circuit. The switch module is configurable (e.g., by setting the DIP switch) to selectively operatively connect the indicator circuit to one of the first plurality of electrodes. In another aspect of the disclosure, an indicator module described above can further include a second plurality of electrodes, each operatively connected to a respective one of the first plurality of electrodes by a conductor such as a conductive wire. Each plurality of electrodes is located at one end of the module so that the module can be connected to another indicator module at each end, or another indicator at one end and a base at the other.

In another aspect of the disclosure, the visual indicator in an indicator module with conductive wires described above includes a plurality of light elements, such as LEDs, with the conductive wires disposed in a more interior region of the module as compared to the light elements, which can be distributed near the periphery of the module. Such an arrangement reduces shadows of the wires cast by the light elements which can be visible from the exterior of the module.

In another aspect of the disclosure, the first plurality electrodes can each include a flexible portion so that when the module is removably attached to another module or a base, each electrode in the first plurality of electrodes is biased against the electrode in the other module or base.

BRIEF DESCRIPTION OF THE DRAWINGS

FIG. 1(*b*) illustrates an indicator assembly with multiple indicator modules, including two different types of indicator modules, specifically both audio and visual indicator modules in this example, and a base according to an aspect of the present disclosure.

FIG. 10(*a*) shows a DIP switch as a switch module included as part of an indicator module according to an aspect of the present disclosure.

FIG. 10(*b*) schematically shows wiring for signal (power) supply to the indicator modules in an indicator assembly according to an aspect of the present disclosure.

FIG. 10(*c*) schematically shows an arrangement of pin connections for the connector in an indicator module base according to an aspect of the present disclosure.

FIG. 10(*d*) shows the correspondence between the pins in FIG. 10(*c*) and modules in FIG. 10(*b*).

DETAILED DESCRIPTION

The present disclosure is made with reference to example devices and methods illustrated in the attached FIGS. 1-12. The example devices and methods allows an indicator module in a modular tower light to be conveniently configured to be powered by any chosen one of the plurality of signal lines regardless of the position of the module in the sequence of modules. In addition, or independently, the plurality of signal lines that run through a visual indicator module can be positioned in the interior region of the module relative to visual signal sources (e.g., LEDs) so that shadows of the conductors cast by the visual signal sources are reduced as compared to modules having the signal lines near or inside transparent/translucent module housing wall.

Figures 1A, 1B:
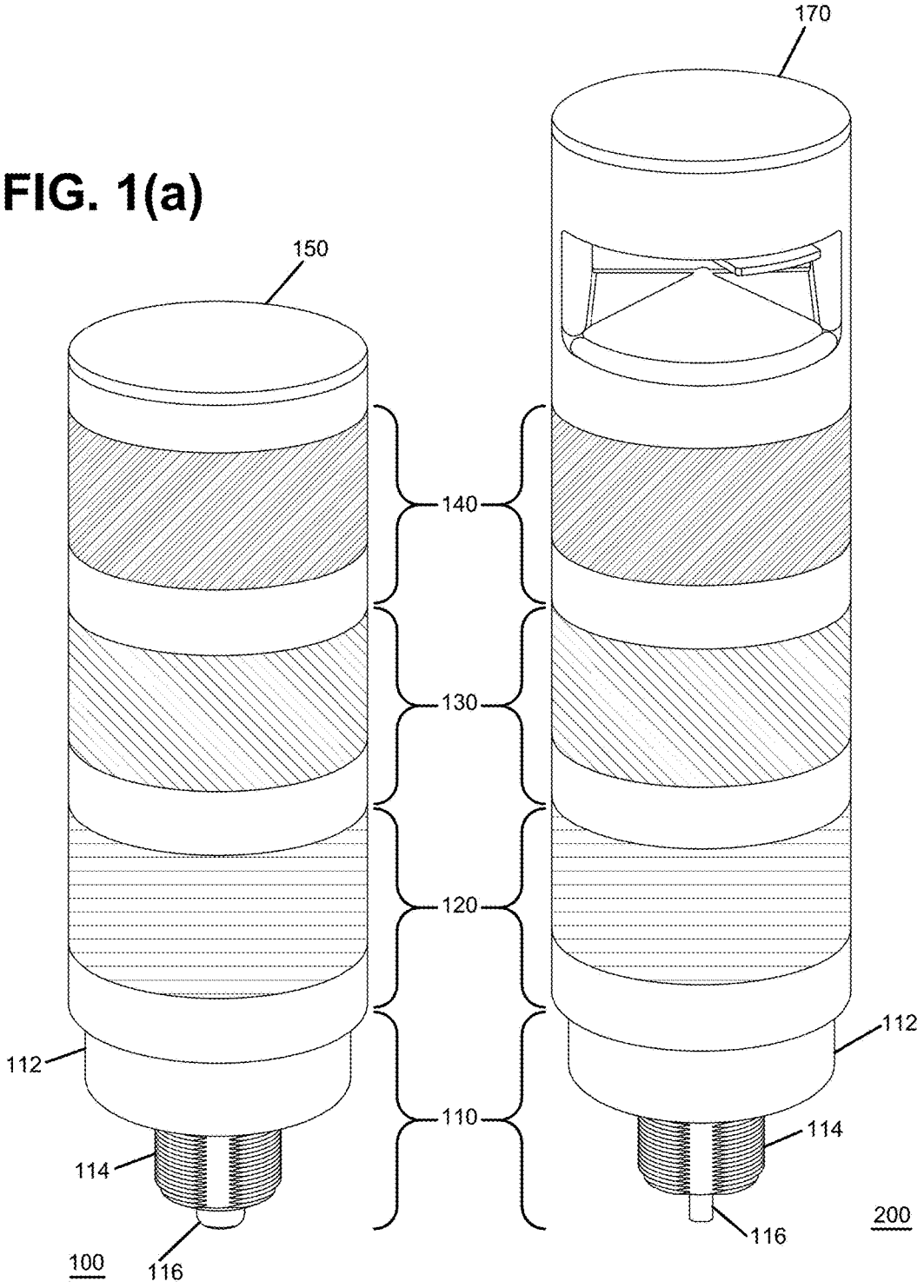
FIG. 1(*a*) illustrates an indicator assembly with multiple indicator modules and a base according to an aspect of the present disclosure.

Referring to FIGS. 1(*a*) and (*b*), example indicator assembles (100, 200) each include a base (110) and several visual indicators (120, 130, 140) mounted on top of each other and on top of the base (110). Each visual indicator (120, 130, 140) can provide a visual indication of a chosen kind, such as color. The top module (140) in assembly (100) can accept additional modules but in this example has a cap (150) mounted at the top. In the assembly (160) in FIG. 1(*b*), an audio indicator module (170) is mounted on top of the top visual indicator module (140). The base (110) includes an indicator mounting portion (112) for attachment to an indicator module (120, 130, 140), a base mounting portion (114) (e.g., a threaded cylindrical portion) for mounting the base on a support such as a bracket, and a connector (116) for electrical connection between the assembly and one or more signal sources, such as a controller, via one or more electrical cables.

Figure 2:
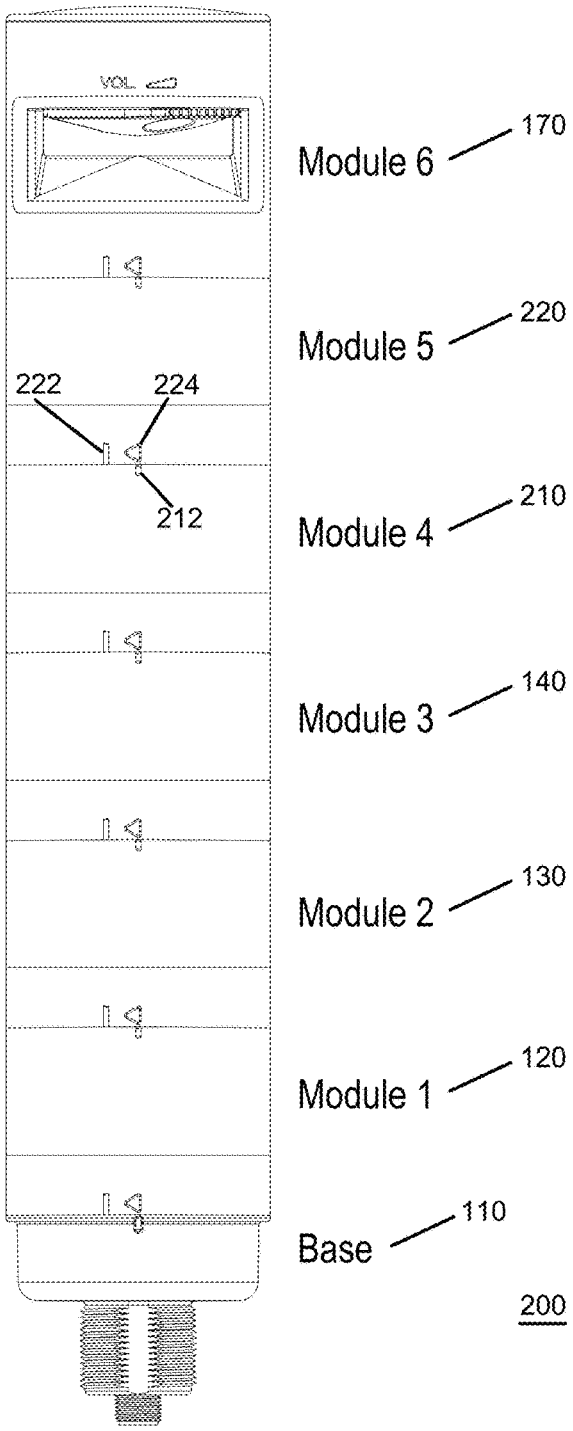
FIG. 2 illustrates another indicator assembly similar to the one shown in FIG. 1(*b*).
Figure 3A:
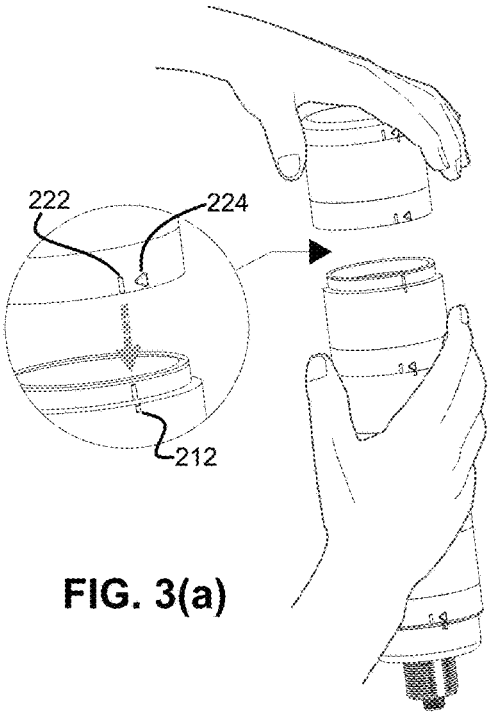
FIGS. 3(*a*) and 3(*b*) show attachment of one indicator module to another indicator module in a plurality of indicator modules in assembling an indicator assembly according to an aspect of the present disclosure.
Figure 3B:
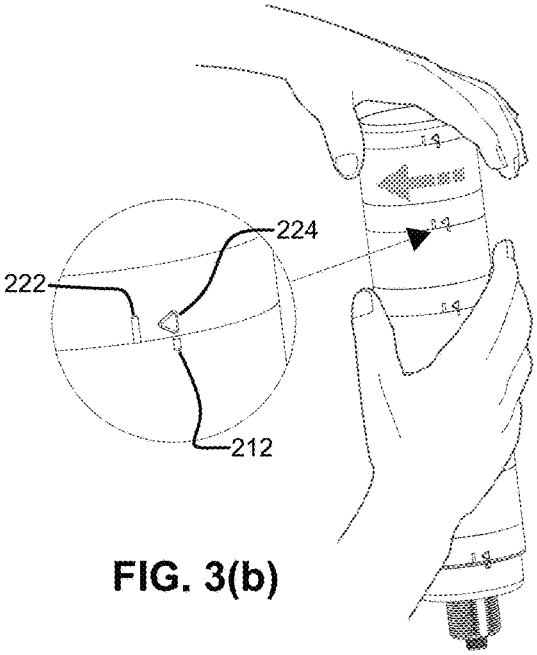

FIG. 2 shows an assembly (200) similar to that (160) shown in FIG. 1(*b*), except that it includes two additional visual modules, lower module (210), upper module (220). FIG. 2 further shows guide marks to assist in mounting two modules to each other by a bayonet-style mount. For example, to attach upper module (220) to lower module (210), a first mark (222) at the bottom of the upper module (220) is first aligned with a first mark (212) at the top of the lower module (210), as shown in FIG. 3(*a*). Then the two modules are pushed together longitudinally and then twisted axially relative to each other until locked, when a second mark (224) at the bottom of the upper module (220) is aligned with the first mark (212) of the lower module (210).

Figure 4:
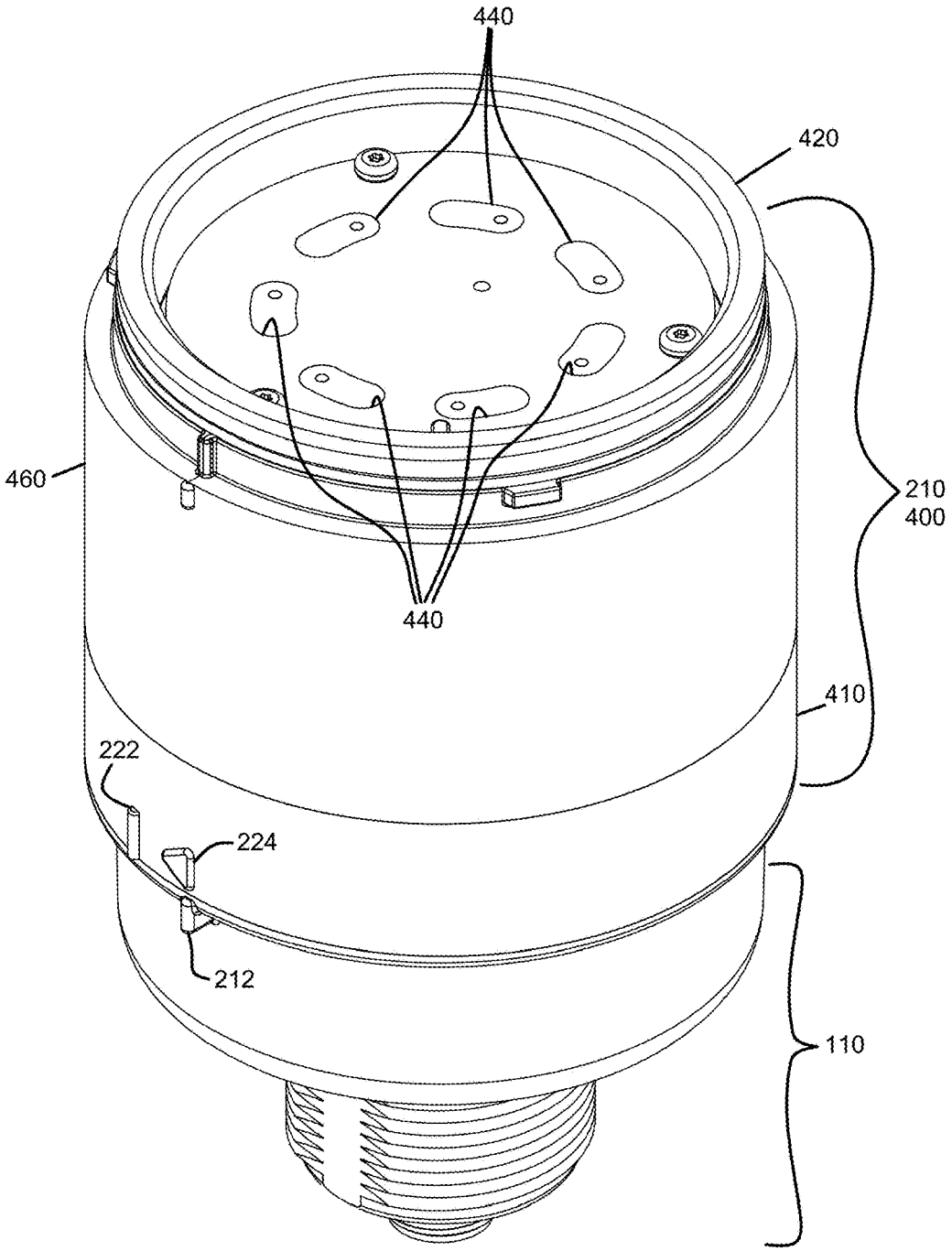
FIG. 4 is a top (referenced to an upright orientation of the assembly) perspective view of an indicator assembly with an indicator module mounted on a base according to an aspect of the present disclosure.
Figure 5:
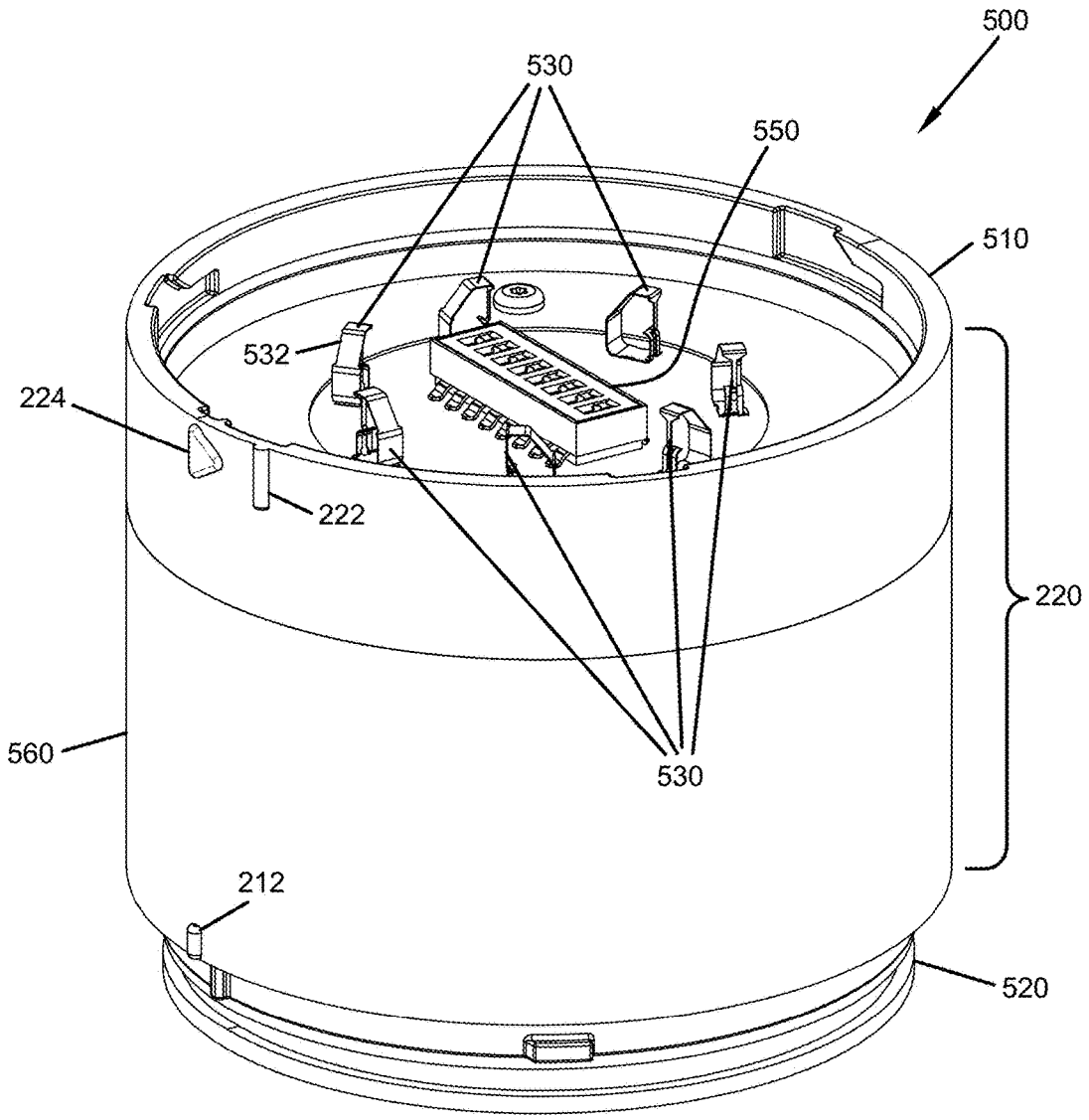
FIG. 5 is a bottom (referenced to an upright orientation of the assembly) perspective view of an indicator assembly according to an aspect of the present disclosure.

Referring to FIGS. 4 and 5, which show examples of two identical indicator modules, lower module (210), upper module (220), FIG. 4 being from a top/side perspective (references to an upright orientation of the assembly), and FIG. 5 being from a bottom/side perspective. Each module has a body portion (400, 500), which includes a bottom mounting portion (410, 510) for mounting the module to an electrical module, such as another module, or a base (110 in FIG. 4; not shown in FIG. 5), below. Each body portion in this case also includes a top mounting portion (410, 520) for attachment to another module, or cap. Each module in these examples also includes a set of bottom electrodes (530 in FIG. 5; not shown in FIG. 4) near or at the bottom mounting portion (410, 510). Each module further includes a set of top electrodes (440 in FIG. 4; not shown in FIG. 5) corresponding to the respective bottom electrodes (530). In the example shown in FIG. 4, the base (110) also has a set of electrodes (not shown) similar to the top electrodes (440) for lower module (210). When a module (210, 220) is mounted on the electrical module, such as another indicator module or a base (110) below, the bottom electrodes (530) of upper module (220) are in contact with the electrodes in the electrical module, such as the top electrodes (440) of lower module (210) or the electrodes (118) of the base (110). See FIG. 9 for an example in which an indicator module body portion (500) is mounted on a base (110).

In this example, the top electrodes (440) are substantially flat and face the direction of the longitudinal axis of the lower module (210). The electrodes (118 in FIG. 9) in the base (110) have a similar structure. The bottom electrodes (530) are flexible so that when the upper module (220) is mounted on the lower module (210) or a base (110), the bottom electrodes (530) are biased against the corresponding top electrodes (440) (or electrodes (118) in the base) to ensure proper electrical contact. In addition, the bottom electrodes (530), in one example, include a sloped section (532) obliquely facing the direction in which the module rotates relative to the module being attached thereto. This configuration ensures proper flex of the bottom electrodes (530) and prevents any protrusion on the top surface (624 in FIG. 8) of the top circuit board (620 in FIG. 8) of the module being attached to from impeding the relative rotation and proper locking between the two modules.

Not all indicator modules need to have both top and bottom electrodes, and top and bottom mounting portions. An indicator module, such as the audio module 170, can be designed to always be the top module in a stack, and as such, needs only to have a bottom mounting portion and bottom electrodes (details not shown).

As shown in FIG. 5, an indicator module in these examples further includes a switch module (550), which in the example shown in FIG. 5, is supported at the bottom of the upper module (220) but can be anywhere accessible by a user. The switch module (550) is used to selectively connect an indicator circuit (to be described later) in the upper module (220) to one of the bottom electrodes (530).

The body portion (400, 500) of each indicator module (210, 220) can also include a housing wall (460, 560), which in the case of an optical indicator module, may be a transparent or translucent wall for transmitting light emitted by an illumination source contained therein.

Figure 6:
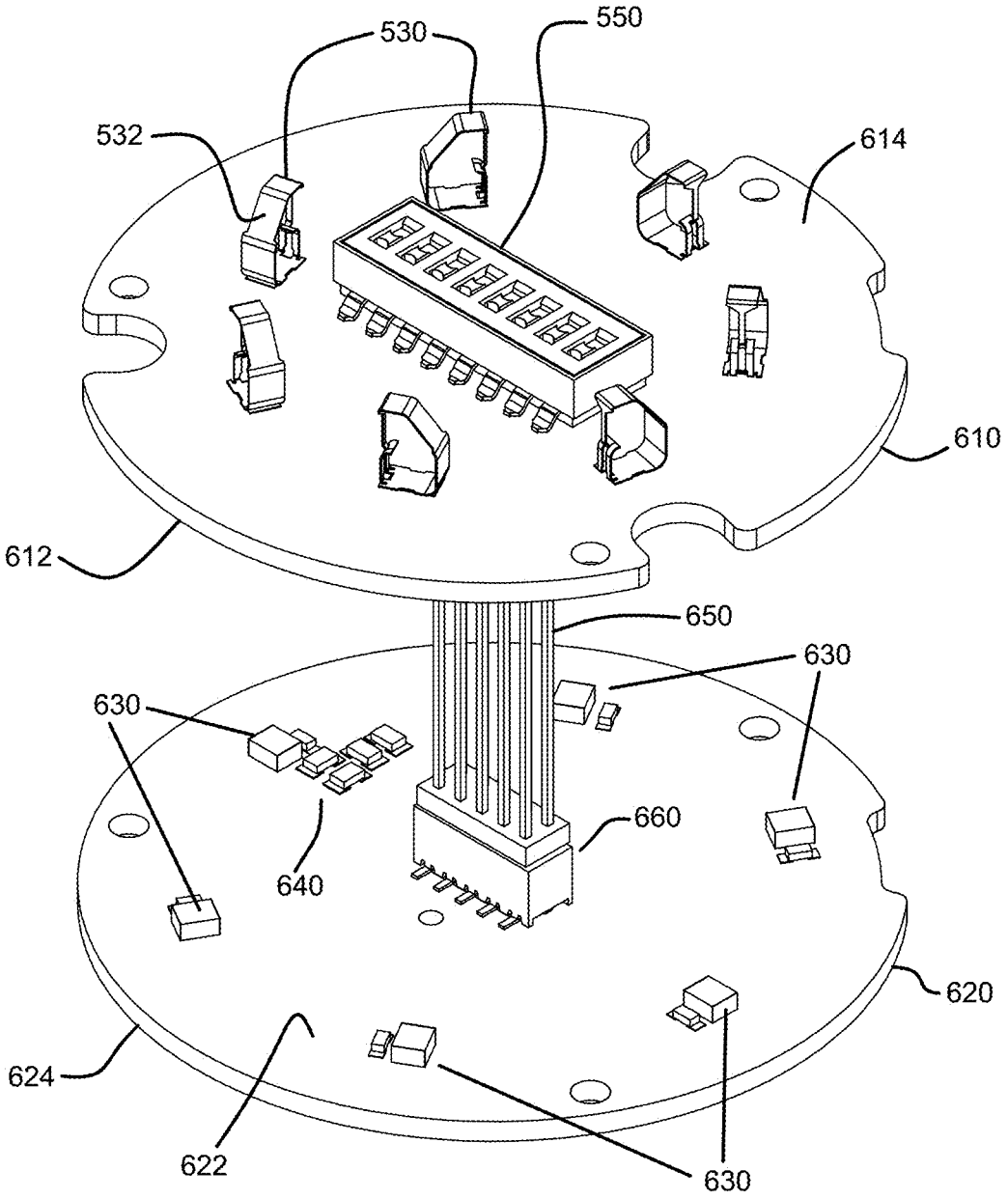
FIG. 6 is a bottom (referenced to an upright orientation of the assembly) perspective view of the indicator assembly shown in FIG. 5 but without the housing.

Referring to FIG. 6, the various electrical and electronic components (640) in an indicator module (210, 220) in this example are supported on a bottom circuit board (610) and a top circuit board (620). For example, the bottom electrodes (530) and switch module (550) are supported on the bottom side (614) of the bottom circuit board (610), and the top electrodes (440) are supported on the top side (624) of the top circuit board (620).

Figure 7:
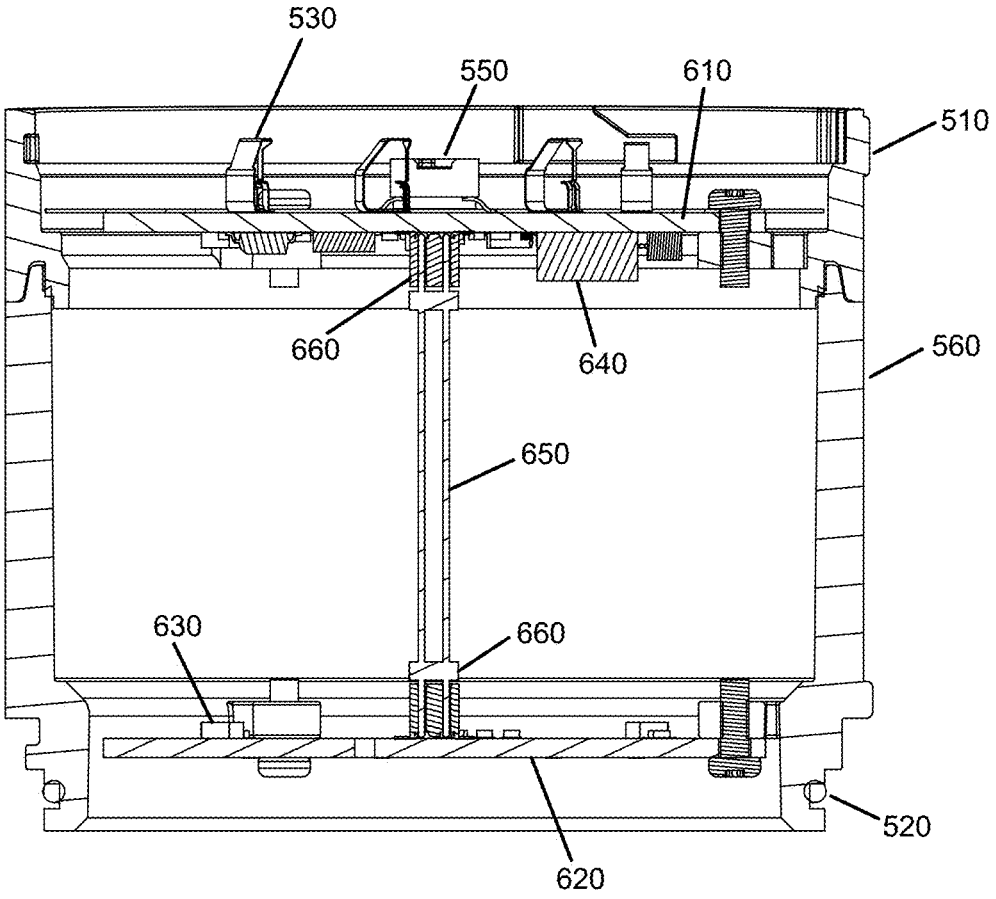
FIG. 7 is a side view of the indicator assembly shown in FIG. 5.

Each module further includes an indicator circuit, which in this example includes light sources (630), such as light emitting diodes (LEDs) and associated electronic components (640), which can include, for example, a driver circuit, blinker circuit and protection circuit. In this case, the light sources (630) are mounted on the bottom surface (622) of the top circuit board (620) and (not shown) on the top surface (612) of the bottom circuit board (610). In this case, the light sources (630) are also distributed near the periphery, or housing wall (560) of the upper module (220). FIG. 7 shows a cross-sectional view of an indicator module, with the bottom circuit board (610) and top circuit board (620) interconnected via the conductors (650) and connectors (660), and with the light sources (630), other electronic components (640), bottom electrodes (530) and switch module (550) mounted the appropriate circuit boards (610, 620).

Figure 8B:
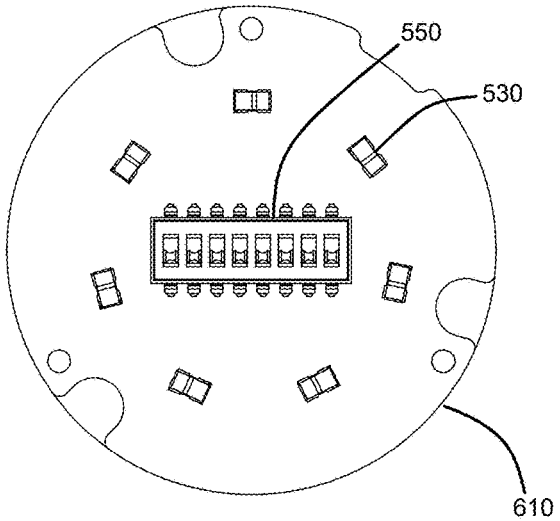
FIGS. 8(*a*), (*b*) and (*c*) are, respectively, bottom, side and top views (referenced to an upright orientation of the assembly) of the components of the indicator module shown in FIG. 6.
Figure 8A:
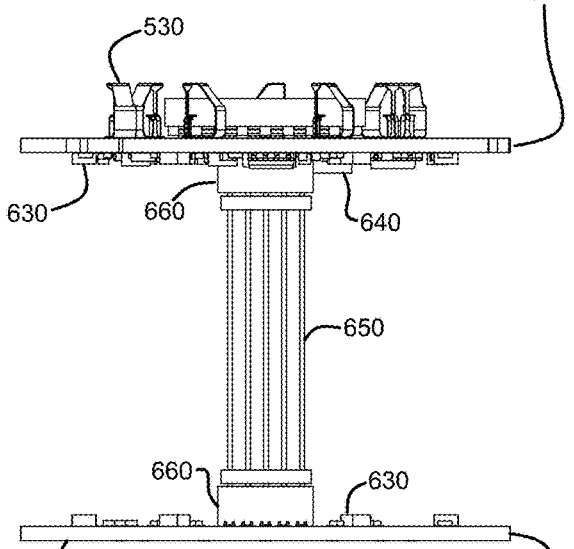
Figure 8C:
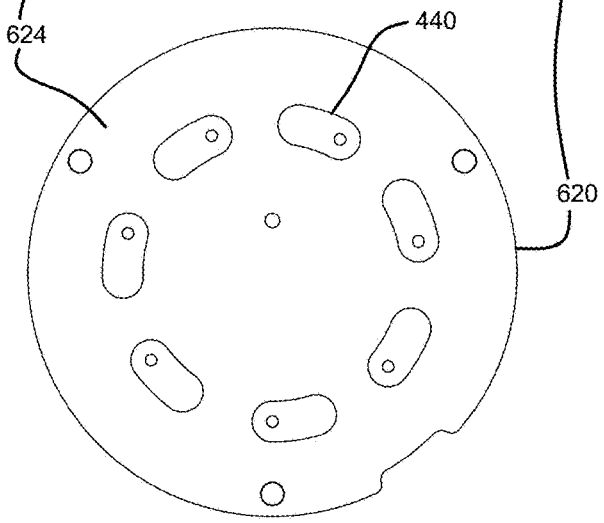

With further reference to FIG. 8, each indicator module (210, 220) in this example further includes conductors (650) connecting the top electrodes (440 in FIGS. 4 and 8; not shown in FIG. 5 or 6) to the bottom electrodes (not shown in FIG. 4; 530 in FIGS. 5 and 6) within each module via connectors (660) and conductive lines (not shown) on the top and bottom circuit boards. The connectors (660) permit the top and bottom circuit boards (610, 620) to be readily assembled together or disassembled. The conductors (650) in this case are disposed in an interior region relative to the light sources (630). With this arrangement, shadows of the conductors (650) cast by the light sources (630) are reduced as compared to the arrangements in which the conductors are disposed near the periphery and light sources are disposed in a more interior region of the module.

Figure 9:
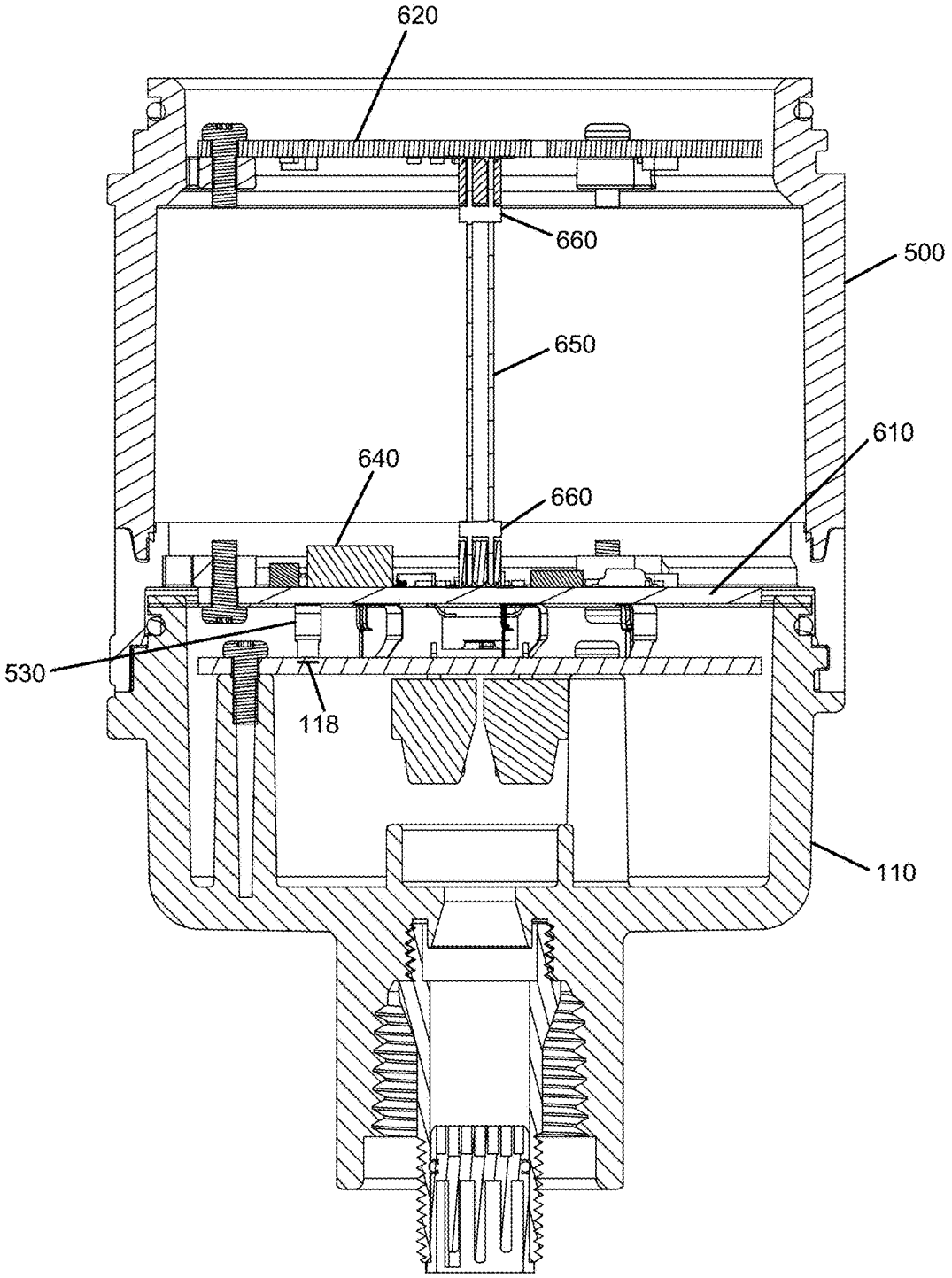
FIG. 9 is a side view of the assembly shown in FIG. 4.
Figure 11:
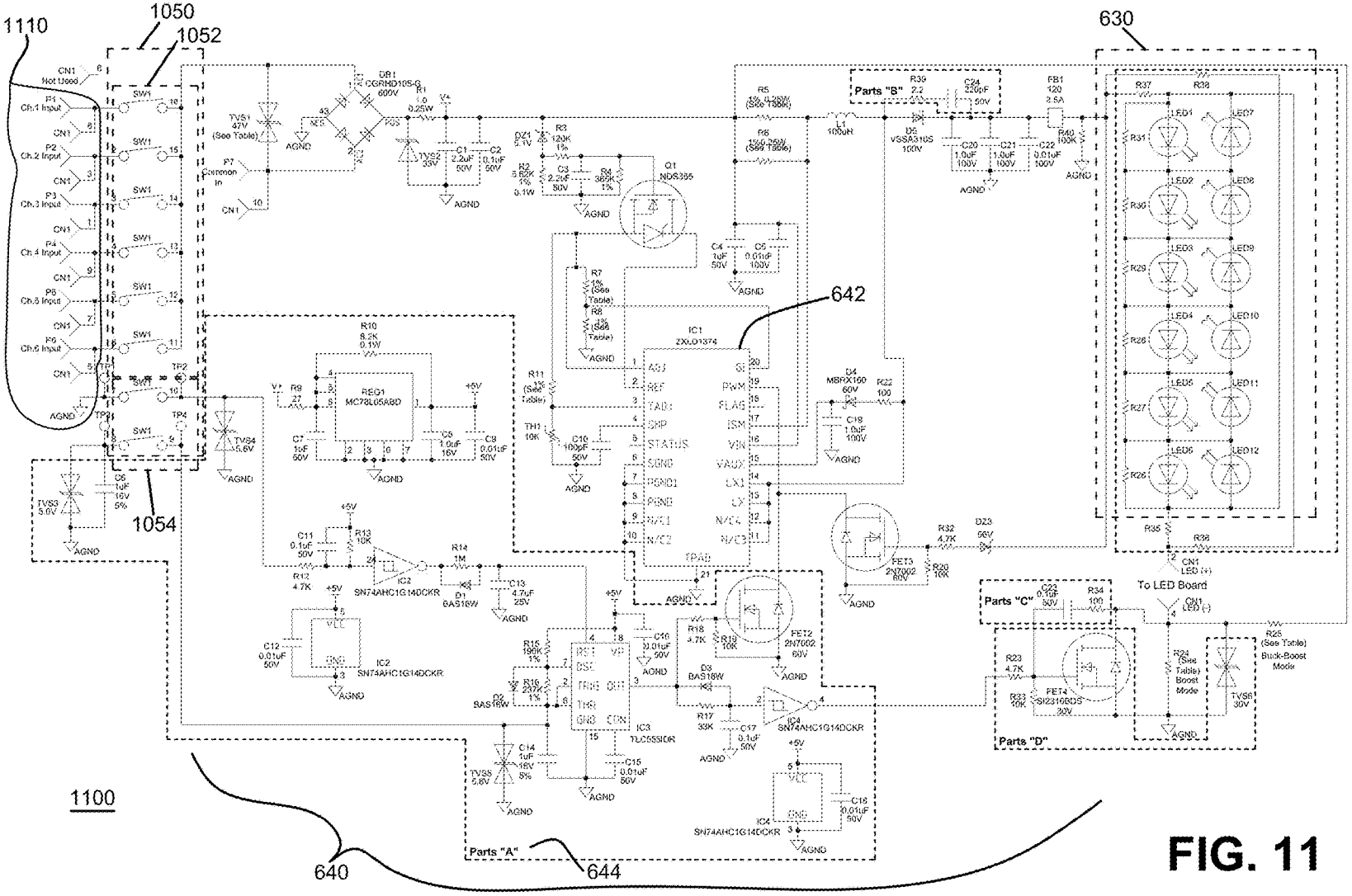
FIG. 11 shows an example circuit diagram of the electronics in a visual indicator module according to an aspect of the present disclosure.
Figure 12:
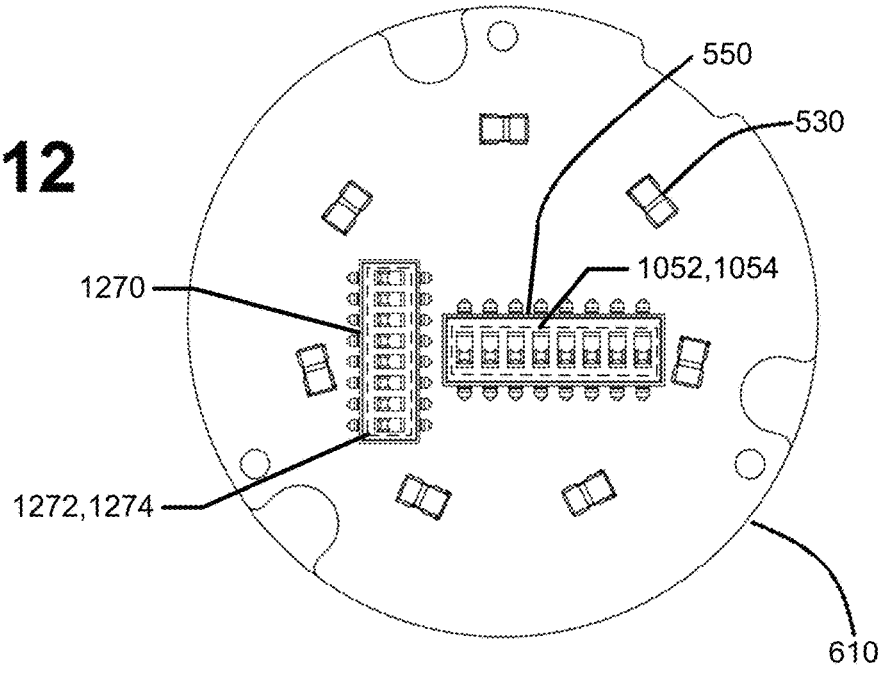
FIG. 12 shows a bottom view (referenced to an upright orientation of the assembly) of the components of an indicator module according to another embodiment.

FIG. 9 shows a cross-sectional view of an indicator module, with the bottom circuit board (610) and top circuit board (620) interconnected via the conductors (650) and connectors (660), and with the bottom electrodes (530), other electronic components (640), and the electrodes (118) of the base (110).

When an indicator assembly (100 or 160) is assembled, there are several conductive paths running through all the modules in the assembly. Several such conductive paths (logically labeled "M1" through "M6" in FIG. 10(*b*)) are connected to respectively signal sources (symbolically illustrated as a set of switches (1060) in FIG. 10(*b*)) such as a controller (not shown) via the connector (116; see FIG. 10(*c*) for pin-out and (d) for identification of the wires). One or more such conductive paths can also be connected to a common terminal, such as ground. Each conductive path includes one conductor (650) and corresponding top and bottom electrodes (440, 530) in each module.

Regarding the switch module (550), one function of the switch is to selectively interconnect the indicator circuit, such as visual indicator circuit (630, 640), with one or more of the conductive paths. For example, the indicator circuit in each indicator module can be connected between the common terminal (e.g., ground) and, via the switch module, selectively to one of the signal sources. The connection can be made, for example, to the bottom electrodes (530) via conductive lines (not shown) in the circuit board (610). The switch module (550) can be any suitable connecting device, including switches such as DIP switches, rotary switches, sliding switches, and the like. Though less convenient, the switching module (550) can also be a jumper arrangement. In an example, shown in FIG. 10(*a*), a part of a DIP switch (1050) is used for the purpose of selectively connecting an indicator circuit to one of the conductive paths. In this case, the DIP switch (1050) has several individual switches (1052, 1054), a subgroup (1052) of which serves to make the selective connections. For example, if the switch element in position "3" in a DIP switch in a module is switched to "ON," the module is "seen" as M3, or Module 3, by the controller, regardless of the physical location of the indicator module in the sequence of modules in the assembly.

As a further example, two or more indicator modules, each occupying a different physical location, in an indicator assembly can be configured to be the same logical module by appropriate setting of the switch module (550). For example, if the switch element in position "3" in a DIP switch in each of two or more indicator modules in an indicator assembly is switched to "ON," each of the modules is "seen" as M3, or Module 3, by the controller. Both or all of the modules set to M3 will be activated. For example, in an indicator assembly (e.g., one as shown in FIG. 2) having both an audio indicator module and a visual indicator module, both indicator modules can be set to the same logical module (e.g., both physical Module 6 (170) and physical Module 4 (210) can be set to be logical Module 3, or M3). When the controller supplies power to the logical module (e.g., Module 3, or M3), both the audio and visual indicator modules will be activated and generate audio and visual signals, respectively. In another example, multiple visual indicator modules in an indicator assembly can be set to the same logical module to produce a desired array of visual signals, such as an array of lights of the same color or any other color pattern.

Other functions can be provided by the switch module (550, 1050). For example, a portion of the DIP switch (1050) can be used to affect the type of indication provided by Module 3 (assuming the switch element in position "3" is "ON"). For example, switch elements in positions "7" and "8" can be used to control whether the indicator module is active continuously or intermittently, and the frequency of intermittent indications (flashes or beeps).

A variety of electrical and electronic circuits can be used to implement specific functional aspects of the indicator module. For example, the circuit schematically shown in FIG. 11 can be used to build a visual indicator module designed for tower lights having up to six independent channels. In this example, a portion (1052) of the switch module (1050) is used to selectively connect the light sources (630) and other electronics (640) via one of the six conductive paths (1110). The circuit (640) includes, among other things, a driver (642) for powering the light sources (630) and timing circuit (644). Another portion (1054) of the switch module (1050) is used to control the blinking indication of the light sources (630). Other suitable circuits can be used, depending the specific desired operation.

In accordance with another aspect of the present disclosure, additional switches can be included in a indicator module (210,220) to enable additional functionalities of the module. The additional switches can be included in the form of additional individual switches (1052,1054) in the switch module (550,1050). Alternatively or in addition, they can be included, as in an exemplary embodiment shown in FIG. 12, in the form of individual switches (1272,1274) in one or more additional switch modules (1270).

For example, the light sources (630) can each be a multi-color LED or a group of discrete single-color LEDs of different colors, and switches (1272,1274) can be connected to power respective LEDs or color components of a multi-color LED to produce a desired color by mixing colors emitted by LEDs or LED components of different colors. For example, an RGB (red-green-blue) LED may provide seven different colors (turning on one, two, three colors); an RGBA (red-green-blue-amber) LED may provide fourteen colors (turning on one, two, three colors) or more. TABLE I below shows an example in which four switches (5B-8B) in a DIP switch module (1270) are used to generate fourteen colors. In this example, the circuit is configured such that turning all switches (5B-8B) on does not result in a state in which all four color components are on; instead, a demonstrative state is reached, which can be, for example, cycling through all fourteen colors while the LEDs are flashing.

TABLE I

Effect of Switch Positions For Switch Module (1270)

| Assembly Options | | DIP Switch (1270) 1B | 2B | 3B | 4B | 5B | 6B | 7B | 8B |
|---|---|---|---|---|---|---|---|---|---|
| Color Selection | Red | | | | | | | | ON |
| | Green | | | | | | | ON | |
| | Yellow | | | | | | | ON | ON |
| | Blue | | | | | | ON | | |
| | Magenta | | | | | | ON | | ON |
| | Cyan | | | | | | ON | ON | |
| | White | | | | | | ON | ON | ON |
| | Amber | | | | | ON | | | |
| | Rose | | | | | ON | | | ON |
| | Lime Green | | | | | ON | | ON | |
| | Orange | | | | | ON | | ON | ON |
| | Sky Blue | | | | | ON | ON | | |
| | Violet | | | | | ON | ON | | ON |
| | Spring Green | | | | | ON | ON | ON | |
| | Color Demo | | | | | | | | |
| | Flash Demo | | | | | ON | ON | ON | ON |
| Flashing and Strobing | Solid On | | | | | | | | |
| | 0.5 Hz Flash | | | | ON | | | | |
| | 1.5 Hz Flash | | | ON | | | | | |
| | 3.0 Hz Flash | | | ON | ON | | | | |
| | 0.5 Hz Strobe | | ON | | | | | | |
| | 1.5 Hz Strobe | | ON | | ON | | | | |
| | 3.0 Hz Strobe | | ON | ON | | | | | |
| | Intensity Sweep | | ON | ON | ON | | | | |
| Intensity | High | | | | | | | | |
| | Low | ON | | | | | | | |

As further illustrated by the example of TABLE I, switches (1272,1274) can be connected to enable other functionalities in similar ways as the switches "7" and "8" (1054) described above. For example, switches 2B-4B can be connected to appropriate circuitry to cause the LEDs to flash or strobe at various frequencies, or to provide intensity sweep (pulse); switch 1B, as another example, can be connected to appropriate circuitry to cause the LEDs to emit light at various intensities.

As summarized in TABLE II below, the switching states of the switches (1052) in the other DIP-switch (550,1050) controls the logical position of each indicator module as described before.

TABLE II

Effect Of Switch Position For Switch Module (550,1050)

| Assembly Options | | DIP Switches (550,1050) 1 | 2 | 3 | 4 | 5 | 6 |
|---|---|---|---|---|---|---|---|
| Position | Module 1 | ON | | | | | |
| | Module 2 | | ON | | | | |
| | Module 3 | | | ON | | | |
| | Module 4 | | | | ON | | |
| | Module 5 | | | | | ON | |
| | Module 6 | | | | | | ON |

The user configurable indicator modules described above can also be used with other types of indicator modules, such as traditional tower light modules, to achieve desired configurations.

Thus, a device and method have been described, which, among other things, provide a high degree of flexibility in configuring modular indicator assemblies (tower lights and the like). By the use of a switch module inside an indicator module, the module can be configured to function as a module in any logical (electronic) position in a multi-indicator assembly, regardless of its location in the physical sequence of the indicator modules in the assembly. The arrangement of the conductive paths relative to optical indicator elements (e.g., LEDs) provides a reduction in shadowing from the conductive paths. Resilient, or flexible, electrodes can be used for proper inter-modular electrical connections.

Many modifications and variations of the examples disclosed herein, and numerous other embodiments of the invention can be made without exceeding the scope of the invention, which is to be measured by the claims hereto appended.

We claim:

1. An indicator module, comprising:

a body portion;

a first plurality of electrodes attached to the body portion, the body portion comprising a first mounting portion adapted to removably attach the body portion to a first electrical module and to put the first plurality of electrodes in electrical contact with respective ones of a plurality of electrodes in the first electrical module;

an indicator circuit comprising a plurality of indicator sources; and a switch module operatively connected to the first plurality of electrodes and to the indicator circuit and configurable to selectively operatively connect the indicator circuit to one of the first plurality of electrodes, the switch module comprising a plurality of switching elements, each operatively connected to a respective one of the plurality of indicator sources and adapted to turn the respective one of the plurality of indicator sources on and off independent of remainder of the plurality of indicator sources.

2. The indicator module of claim 1, wherein each of the plurality of indicator sources comprises a visual indicator, at least two of the plurality of visual indicators having different colors from each other.

3. The indicator module of claim 2, wherein the body portion comprises a substantially cylindrical, translucent or transparent, wall defining a longitudinal axis and having two ends, wherein each of the visual indicators comprises a light emitter, a portion of the plurality of the light emitters being disposed proximal to one of the ends, and another portion of the plurality of the light emitters being disposed proximal to another of the ends.

4. The indicator module of claim 1, wherein the switch module is further configurable to selectively operatively connect the indicator circuit to one of the first plurality of electrodes independent of whether the indicator circuit is connected to any other one of the first plurality of electrodes.

5. The indicator module of claim 1, further comprising a second plurality of electrodes attached to the body portion, the body portion further comprising a second mounting portion adapted to removably attach the body portion to a second electrical module and put the second plurality of electrodes in electrical contact respective ones of a plurality of electrodes in the second electrical module.

6. The indicator module of claim 5, further comprising a plurality of conductors each connecting one of the first plurality of electrodes to a respective one of the second plurality of electrodes, wherein the body portion defines a region between the first and second mounting portion, wherein the plurality of conductors are disposed in an interior portion of the region, and wherein the indicator circuit comprises a plurality of light emitters disposed in more peripheral locations in the region than the plurality of conductors.

7. The indicator module of claim 6, wherein the body portion comprises a substantially cylindrical, translucent or transparent, wall defining a longitudinal axis and having two ends, the first and second mounting portion being disposed substantially that the respective ends, wherein the plurality of light emitters are disposed more closely to the wall than the plurality of conductors.

8. The indicator module of claim 7, wherein the plurality of conductors are disposed in a connector module disposed substantially along the longitudinal axis.

9. The indicator module of claim 7, wherein the second plurality of electrodes each comprise a flat contact area facing substantially in a direction along the longitudinal axis.

10. The indicator module of claim 2, wherein the plurality of visual indicators are respective color components of a multi-color light-emitting diode (LED).

11. The indicator module of claim 10, wherein the body portion further comprises a substantially cylindrical, translucent or transparent, wall defining a longitudinal axis and having two ends, the first and second mounting portion being disposed substantially that the respective ends, wherein the indicator circuit comprises a plurality of light emitters, a portion of the plurality of the light emitters being disposed proximal to one of the ends, and another portion of the plurality of the light emitters being disposed proximal to another of the ends.

12. The indicator module of claim 1, wherein the indicator circuit comprises a multi-color light source, the indicator module further comprising a switch configurable in a plurality of switching states to cause the multi-color light source to emit different colors depending on the switching state.

13. The indicator module of claim 1, wherein the switch module is adapted to cause at least one indicator source to produce a signal with time-varying intensity.

14. An indicator assembly, comprising a plurality of indicator modules, each comprising:

a body portion;

a first plurality of electrodes attached to the body portion, the body portion comprising a first mounting portion;

an indicator circuit comprising a plurality of indicator sources; and a switch module operatively connected to the first plurality of electrodes and to the indicator circuit and configured to selectively operatively connect the indicator circuit to one of the first plurality of electrodes, the switch module comprising a plurality of switching elements, each operatively connected to a respective one of the plurality of indicator sources and adapted to turn the respective one of the plurality of indicator sources on and off independent of remainder of the plurality of indicator sources the plurality of indicator modules being pair-wise removably attached to each other by the respective mounting portions, the first plurality of electrodes of each of the plurality of modules being in electrical contact with respective ones of the plurality of electrodes of the indicator module removably attached to it.

15. The indicator module of claim 14, wherein at least one of the first plurality of electrodes comprises a flexible portion, and wherein the body portion further comprises a substantially cylindrical, translucent or transparent, wall defining a longitudinal axis, the first mounting portion is adapted to secure the body portion to the first electrical module, the flexible portion adapted to bias the electrode against the respective electrode in the first electrical module in a direction along the longitudinal axis.

16. The indicator assembly of claim 14, wherein at least one of the plurality of indicator modules further comprises a second plurality of electrodes attached to the body portion, the body portion further comprising a second mounting portion adapted to removably attach the body portion to an electrical module and put the second plurality of electrodes in electrical contact respective ones of a plurality of electrodes in the second electrical module.

17. The indicator assembly of claim 16, wherein the indicator module comprising the second plurality of electrodes further comprises a plurality of conductors each connecting one of the first plurality of electrodes to a respective one of the second plurality of electrodes.

18. The indicator assembly of claim 17, wherein the body portion of the indicator module comprising the second plurality of electrodes defines a region between the first and second mounting portion, wherein the plurality of conductors are disposed in an interior portion of the region, and wherein the indicator circuit comprises a plurality of light emitters disposed in more peripheral locations in the region than the plurality of conductors.

19. The indicator assembly of claim 14, further comprising a base module comprising a support having a mounting portion, a plurality of electrodes mounted on the support, the electrodes connectable to respective power sources, at least one of the indicator modules removably attached to the base by the respective mounting portions, one of the first and second plurality of electrodes of each of the plurality of modules being in electrical contact with respective ones of the plurality of electrodes of the base.

* * * * *